United States Patent [19]

MacLean

[11] 4,255,733

[45] Mar. 10, 1981

[54] LATCHING SWITCH RELAY

[75] Inventor: Alexander MacLean, Hingham, Mass.

[73] Assignee: Electro Switch Corp., Weymouth, Mass.

[21] Appl. No.: 873,431

[22] Filed: Jan. 30, 1978

[51] Int. Cl.[3] ..... H01H 3/00

[52] U.S. Cl. ..... 335/190; 200/153 SC; 335/73; 335/186

[58] Field of Search ..... 200/153 SC; 335/186, 335/189, 190, 191, 73

[56] References Cited

U.S. PATENT DOCUMENTS

| | | | |
|---|---|---|---|
| 2,452,065 | 10/1948 | Moran et al. | 335/190 X |
| 2,591,336 | 4/1952 | Bordelon | 335/186 X |
| 2,910,557 | 10/1959 | Salzer et al. | 200/70 X |
| 3,898,420 | 8/1975 | Evans | 200/153 SC |
| 4,001740 | 1/1977 | MacLean | 335/190 X |

*Primary Examiner*—Fred L. Braun

*Attorney, Agent, or Firm*—Wolf, Greenfield & Sacks

[57] ABSTRACT

A latching switch relay has a selector hub which moves a contact carrying rotary switch shaft along with its contacts from a first to a second position. The selector hub moves to a corresponding first and second position to cause movement of the shaft by remote actuation of a rotary solenoid or by manual operation of a handle linked to the selector hub. A spring is engaged with the selector hub to resiliently urge the switch shaft into its first and second positions.

16 Claims, 7 Drawing Figures

LATCHING SWITCH RELAY

BACKGROUND OF THE INVENTION

The electrical power industry has many requirements for medium power, such as the 15 amp range, two-position switching devices that provide contacts which when opened or closed, stay in the selected position. These positions are mechanically held or maintained until a subsequent operation causes a change. Ordinarily manually operated rotary switches or remote operated relays are used to provide the maintained contacting. Although rotary switches and remote operated relays can have contacts of equal electrical rating and can operate between two functional positions, these devices are not directly interchangeable.

For example, manually operated rotary switches can provide a large number of electrical contacts that can be maintained in either position but are not designed to operate between positions by remote control. Conventional electromechanical relays operate by remote control, i.e. activation of an electric power source, between two positions (operate or release for example) but typically do not provide for a large number of contacts. Moreover, relay devices often do not provide maintained contacts because coil power to the relays has to be supplied constantly to hold normally opened contacts closed. Also, the relay design is such that conventional devices do not provide for manual operation.

In many cases electric power systems designs include both relays for remote operation and separate manually operated rotary switches. This can result in redundancy in switching schemes which adds to expense and system complexity sometimes with reduced reliability.

It is now recognized that it is desirable to have a single switching device which has the characteristics of both a manually operated rotary switch and a remote operated latching relay which device is called a latching switch relay in this specification.

SUMMARY OF THE INVENTION

It is an important object of this invention to provide an electrical switch for use in switching electrical power, which switch has the characteristics of conventional manually operated rotary switches and electrical mechanical relays in a single switch.

It is another object of this invention to provide an electrical switch which can be operated remotely or manually and which is highly reliable in operation and provides for maintaining contacts in an opened or closed position while resisting change in position by random shock or vibration.

Still another object of this invention is to provide an electrical switch in accordance with the preceding objects which permits utilization of a rotary solenoid in a compact switch permitting switching manually or remotely for many cycles at high speed and which provides spring means for providing the application of mechanical drive force to cause angular rotation greater than angular rotation of the rotary solenoid.

According to the invention, a latching switch relay can be operated manually or remotely by electrical power to rotate a shaft clockwise or counterclockwise as desired. Preferably the shaft is rotated from a 0° position which is a first position of contacts carried by the contact carrying shaft to a 45° position which is the second position of the shaft and vice versa.

The latching switch relay has a spring means for urging the contact carrying shaft into the first position and resiliently maintaining the shaft in the first position with the spring means further acting to alternately urge the shaft into the second position and resiliently maintain the shaft in the second position as desired. A rotary solenoid is provided for causing movement of the shaft from the first to the second position and vice versa. The rotary solenoid carries a drive link for translating unidirectional driving torque of the solenoid into mechanical power to alternately move the shaft clockwise to the second position and counterclockwise to the first position.

Preferably the spring means engages a selector hub which is bound to a coaxially located contact carrying shaft so that clockwise or counterclockwise movement of the selector hub causes corresponding rotation of the shaft. Preferably a manually operable handle shaft is linked to the contact carrying shaft through engagement with the selector hub so that the contact shaft can be moved from the first to the second position and vice versa by operation of the handle shaft. The remote operation permits actuation of the solenoid for a single arcuate movement of a drive arm connected to the solenoid shaft to move the contact shaft from whatever position it is in to the other position. The handle shaft can be operated to do the same and either the handle shaft or remote operation of the solenoids causes movement of the position of the contact shaft without having to first disengage one or the other of the movement causing portions of the switch.

It is a feature of this invention that the devices can be highly compact since an energy efficient rotary solenoid is used. The solenoid requires very little space because of its small size; yet, provides a great deal of mechanical torque. The output of the rotary solenoid is always unidirectional. It can only drive through an angle in one direction of rotation. A drive link in accordance with this invention translates drive in one direction from the rotary solenoid to driving the contact shaft in either of two directions, that is, clockwise or counterclockwise. Moreover, the spring means act to increase the angle of operation of the contact shaft. Thus the rotary solenoid is selected to have an angular output of 25° while the spring begins acting to shift the contacts from one position to the other after movement of the rotary solenoid through an angular path of something less than 25° so as to provide power to move the shaft to an angle of 45° in the preferred embodiment. The present invention provides an electrical switching means which can be operated manually or remotely for many cycles, at high speed, while providing a great deal of reliability.

BRIEF DESCRIPTION OF THE DRAWINGS

The above and other objects, advantages and features of the present invention will be better understood from the following specification when read in conjunction with the accompanying drawings in which.

BRIEF DESCRIPTION OF THE PREFERRED EMBODIMENTS

Figure 1:
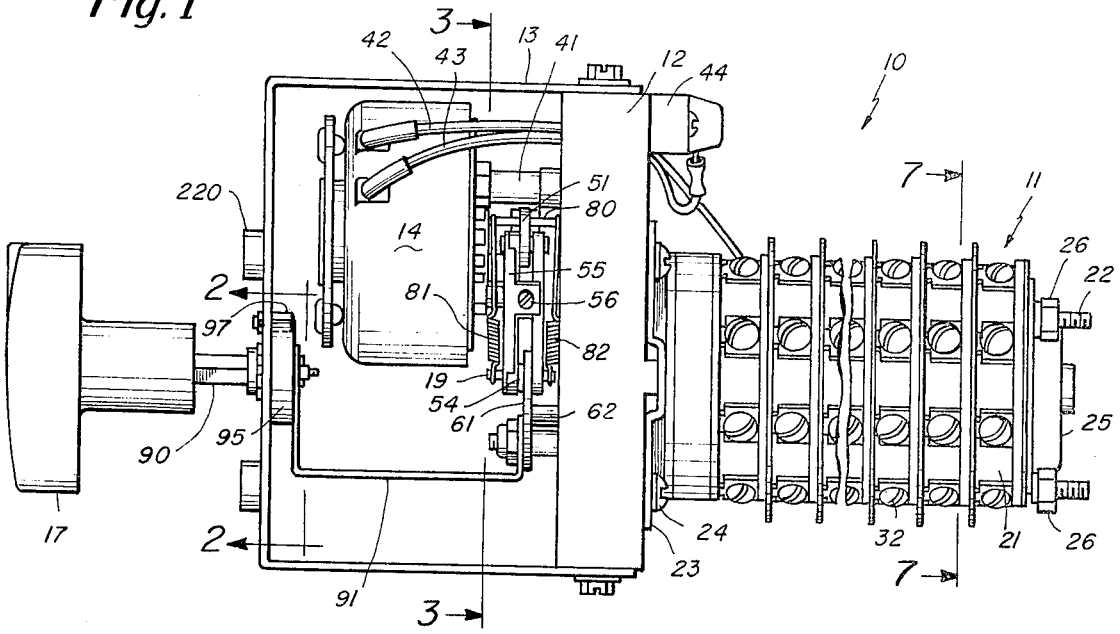
FIG. 1 is a right-side view of a preferred embodiment of a latching switch relay in accordance with this invention.
Figure 2:
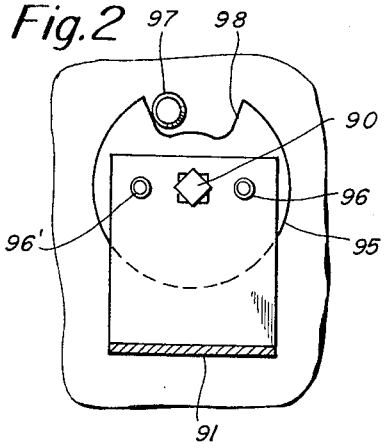
FIG. 2 is a detail thereof taken through line 2—2.

With reference now to the drawings a preferred embodiment of a latching switch relay in accordance with this invention is illustrated at 10 and comprises a rotary switch section 11 mounted on a metallic support wall 12 which also carries a C-shaped housing cover 13 within which is mounted a rotary solenoid 14. The rotary solenoid is linked to a contact carrying switch shaft 16 as is the handle 17 by a selector hub 20 and associated drive means. A spring means 100 acts to drive the selector hub through part of its rotational movement along with shaft 16 and to resiliently urge and maintain the selector hub and shaft 16 in either one of two positions 45° apart.

Figure 7:
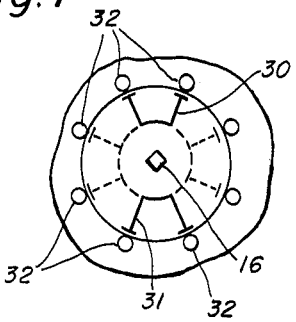
FIG. 7 is a semidiagrammatic view taken through line 7—7 showing contacts of the rotary switch portion of the invention.

The switch section 11 is made up of any desired number of plastic rotary segments or discs. Segments 21 are bound together by three triangularly arranged through spindles 22 extending to a mounting flange 23 which is in turn screwed by corner screws 24 to the support wall 12. An end plate 25 at one end of the segment group is maintained in position by nuts 26 as known. The rotary switch section includes a switch shaft 16 mounted in a suitable bearing in plate 25 as known in the art, and carries contacts 30 and 31 adapted to move from the full line position to the dotted line position during 45° of arcuate movement of the shaft 16 (FIG. 7). Contacts 32 pass into the interior space of the segments with suitable connector screws arranged on the outside of the segments as known. Rows of contacts are shown in FIG. 1 and in the preferred embodiment there are eight longitudinally extending rows and eight segments forming eight vertically arranged columns of contacts.

The rotary solenoid 14 is mounted to the support wall 12 by support bars 40 and 41 with electrical connections 42 and 43 passing to a terminal block 44 and one of the contacts of the rotary switch as best shown in FIG. 1. Wires 42 and 43 can be connected to suitable circuitry to provide power at selected times in order to remotely operate the switch to move it from a first switch position to a second switch position corresponding to the dotted outline and full line position of the contacts as shown in FIG. 7.

The rotary solenoid has a solenoid shaft 50 on which is a drive arm 51 fixed to the shaft by a pin 52. A pin 53 pivotally mounts a drive link 18 which carries a pin 19 pivotally mounting a roller 54 which pivots freely on the pin 19. The drive link has a casing portion 55 of sheet metal held in place by a screw 56 to lock the pins 53 and 19 in position.

Figure 3:
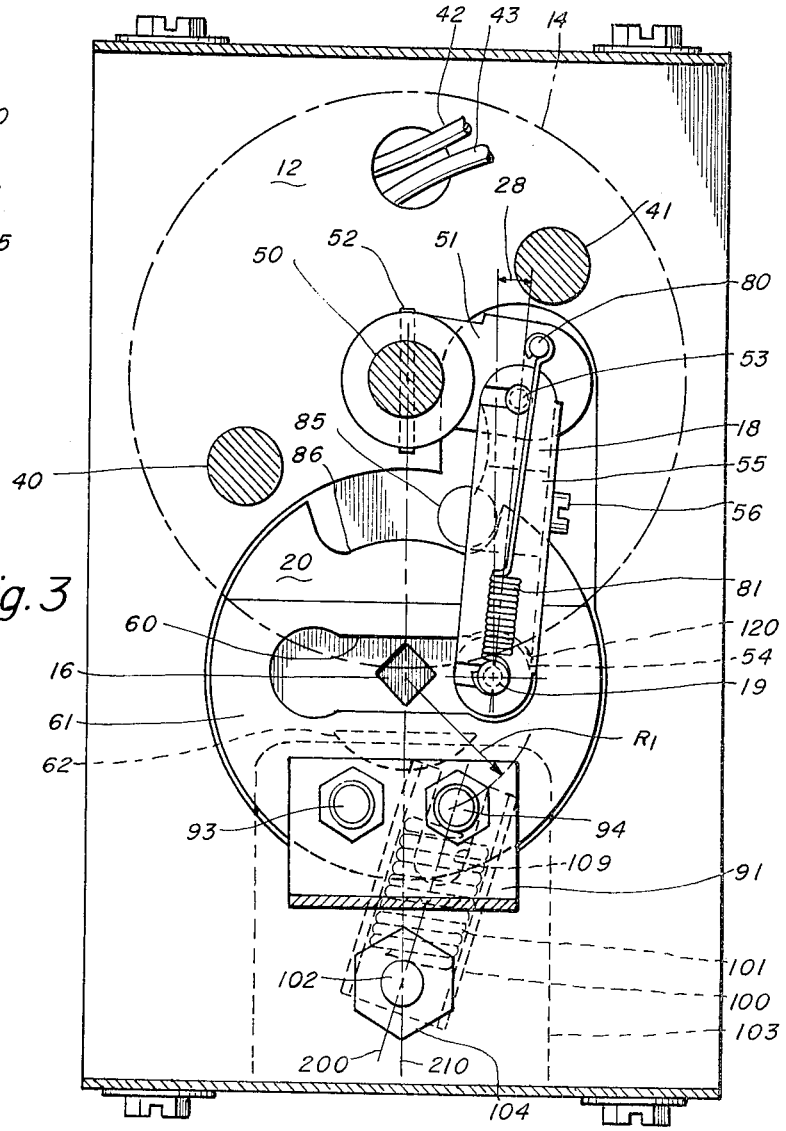
FIG. 3 is a cross sectional view taken through line 3—3 of FIG. 1.
Figure 4:
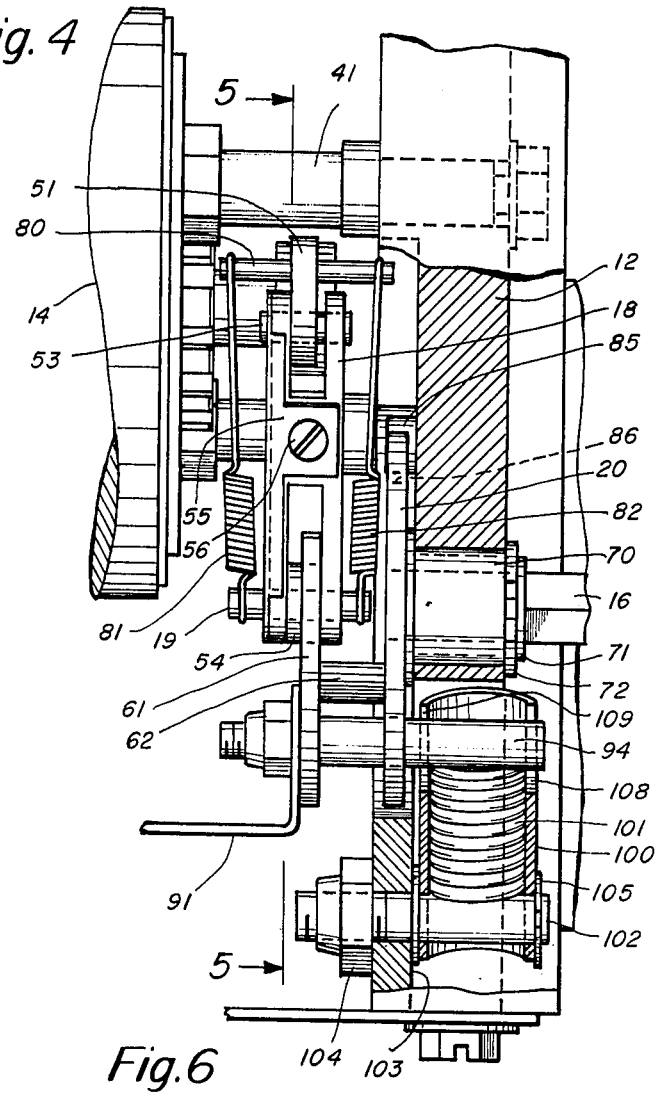
FIG. 4 is an enlarged fragmentary side view showing a preferred embodiment of certain operating linkages in accordance with a preferred embodiment of this invention.

Roller 54 is mounted within a slot 60 of a selector plate 61 which is in turn fixed to the selector hub 20 by a cresent-shaped metal piece 62. An extension sleeve covered post and spindle 94 extends through the plate 61 as best shown in FIGS. 3 and 4. Post 93 aids in attaching member 91 to selector plate 61.

The selector hub 20 is mounted for rotation in a bearing 70 in support wall 12 with a C-shaped retaining ring 72 maintaining the hub in the wall for rotation about a central axis corresponding to the central axis of contact carrying shaft 16. Shaft 16 is keyed and fixed to the selector hub 20 through a neck portion 71 thereof best shown in FIG. 4.

Rotation of the selector plate 61 about the axis of shaft 16 causes corresponding rotation of the selector hub which is freely rotatable in the bearing 70.

A pin 80 extends on each side of the driver arm 51 and mounts springs 81 and 82 at one end with their other ends being mounted by pin 19 as best shown in FIGS. 3 and 4. These springs tend to urge the end of the drive link 18 toward the driver arm 51.

The selector hub 20 is mounted adjacent a stop 85 fixed on the support wall 12 at a position to engage ends of a cutout portion 86 of the selector hub and thus fix two extremes of rotation of the selector hub as will be more fully described.

The selector hub and its selector plate is linked to the handle 17 and its shaft 90 through a linkage member 91 in the form of a resilient metal C-shaped plate. One end of the plate is bolted to and fixed on the selector plate 61 by posts and bolts 93, 94. The second end is bolted to a circular plastic bearing 95 by bolts 96, 96'. Plastic bearing 95 is mounted for rotational movement with the shaft 90 fixed thereto and about the shaft axis. Movement of the handle shaft is limited by a stop 97 extending from the cover 13 which mates with a cutout portion 98 to determine positions corresponding to the first and second position of the switch shaft.

A spring means comprises a guide sleeve 100 within which is a compression spring 101 with the sleeve mounted for pivoting about a pin 102 within a recessed area 103 of the support wall 12. The pin 102 is held in immovable position by nut 104 and retaining ring 105. The post 94 extends outwardly from the selector hub 20 and engages aligned U-shaped slots 108, 109 in the guide sleeve. The position of the selector hub and its fixed post 94 determines the spring force exerted by the guide sleeve as will be described. The guide sleeve allows pivoting about pin 102.

Turning now to the operation of the latching switch relay device of this invention, and more particularly with reference to FIGS. 1 and 3, the drive system is shown in the 0° rotational position of the contact carrying shaft 16 and the corresponding 0° position of the selector hub 20. The selector hub 20 is held in the 0° position by a resilient force acting along the center line 200 of the compression spring 101 which applies a counterclockwise force to the post 94 to resiliently urge the selector hub 20 into engagement with the stop pin 85. This stabilizes the selector hub at 0° and thus stabilizes the switching contacts carried by the shaft 16.

Figure 6:
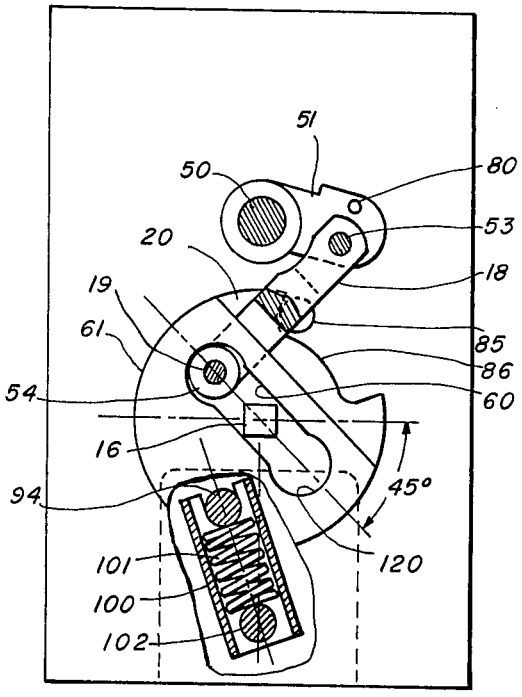

When the latching switch relay drive system is operated manually clockwise to the 45° position from the position shown in FIG. 3, to the position shown in FIG. 6, torque is delivered to the selector hub 20 by the handle shaft linkage member 91. This clockwise torque overcomes the counterclockwise torque already applied to the selector hub by the compression spring 101 as previously described. The selector hub rotates clockwise following the handle shaft 90 which is preferably along a line coaxial with shaft 16. Post 94 also rotates clockwise moving along a radius having its center at the axis of shaft 16. This in turn causes the guide sleeve 100 and the compression spring 101 to pivot on pin 102 while overcoming an increasing force on the drive post 94. The force increases as the drive post 94 rotates through its angle along the radius R1 since the compression spring is further compressed from its switch position at 0°. At 0°, the spring is compressed to provide the resilient force to maintain the switch shaft in its position. The same resilient force is maintained in the 45° position. Maximum compression of the spring 101 and thus maximum energy storage in the spring occurs when the angle over which the center line 200 is moved closes so that the center line 200 is coincident with a center line 210 drawn through the center of the solenoid shaft, contact carrying switch shaft, and pin 102. This is mechanical dead center for the selector hub and it has no torque applied to it tending to move it in either direction insofar as the spring 101 is concerned. Thus, it has no tendency to rotate in either direction. Once the center of the drive post 94 has moved clockwise beyond the center line 210, the selector hub 20 continues to rotate by a torque other than that supplied by manual rotation of the switch shaft handle 17. This torque results from the stored energy in the compression spring 101 which is imparted to the drive post 94 as the spring expands in the guide sleeve 100. The expansion continues until the selector hub has rotated fully to the 45° position as shown in FIG. 6 and has thus impacted against the stop 85 and is resiliently urged into this 45° position. Of course the switch shaft 16 and contacts move along with the selector hub.

When the selector hub 20 rotates lightly more than 22½° the compression spring 101 acts to drive the selector hub and attached contact shaft 16 so that about 25° rotation of the rotary solenoid is sufficient to actuate the spring to drive the shaft through the remaining degree of rotation necessary to achieve 45° of rotation of the switch shaft 16. This enables use of a smaller size solenoid than would be possible should it be necessary to use a 45° output solenoid.

Figure 5:
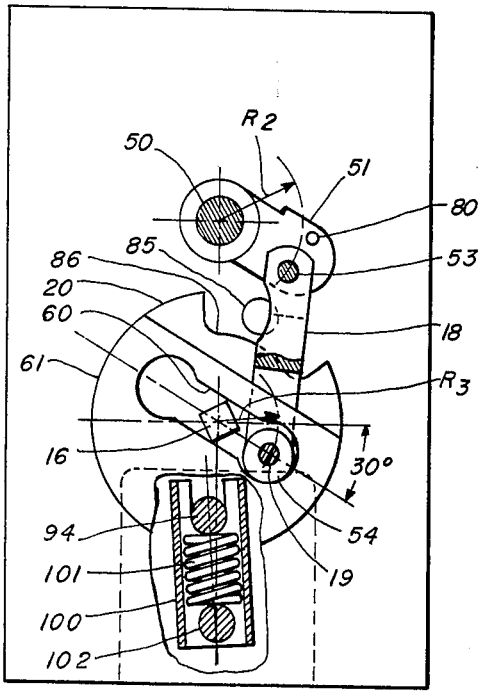
FIGS. 5 and 6 are cross sectional views taken through line 5—5 of FIG. 4 and showing two different positions of the switch with the contact shaft thereof rotated from 0° to 45°.

The drive link 18 transmits the output stroke of the solenoid 14 to the selector hub 20 during remote operation. The position of the drive link 18 is maintained in relation to the other mechanical components as shown in FIG. 3. This is accomplished by springs 81,82 producing a counterclockwise torque on the drive link 18 which results from the force of springs 81,82 acting along the center line or axis of the coil springs which are parallel to each other. This center line is at an angle to a center line through pins 19 and 53. This fixes pin 19 and roller 54 firmly in the extreme right of the slot 60. The mechanics noted with respect to fixing the roller 54 in the position of FIG. 3 essentially reverse and position the roller 54 to the extreme left of the slot when in the 45° position of FIG. 6. The slot 60 is not a parallel sided slot for its entire length. As best seen in FIGS. 3, 5 and 6, the parallel walls of the slot intersect two circles at the ends of the slot which circles have a diameter greater than the distance between the parallel slot side walls.

When the latching switch relay device is at 0° as shown in FIG. 3, the roller 54 has its center slightly to the right of the center of the circular portion of the slot indicated by the intersection of the X and Y lines. That is the roller is pressed against the end of the slot. This provides a clearance at the top and bottom of the roller 20 as shown in FIG. 3 so that the springs 81 and 82 act as described above. The diameter of each of the end portions of the slot also serve two other functions as will be described.

When the handle 17 is manually operated, the diameter of the selector plate is rotated along with the selector hub. This causes the roller 54 to be drawn to the top of the circular portion 120 uppermost along the Y axis and as the selector hub 20 continues to rotate, the roller 54 is held captive in the upper arc due to the force acting along a line passing from the center of pin 19 to the center of pin 53. This force is caused by the return spring built into the rotary solenoid that holds the solenoid shaft in the rest position or returns it to the rest position. This action constantly urges the solenoid shaft 50 and the drive arm 51 in a counterclockwise direction of rotation. The roller 54 remains locked into the top of the slot arcuate portion 120 shown in FIG. 3 until the selector hub has rotated to about 30°. At this point, the drive arm 51 has been pulled 25° to its extreme by the drive link 18 and cannot be pulled further. Then the rotary solenoid return spring which is wound to its maximum force and the force along the line through the center of pin 19 toward the center of pin 53 is also at its maximum. The post 94 has correspondingly rotated clockwise beyond the center line 210 so that the selector hub 20 is driven by resilient spring force toward the 45° position shown in FIG. 6 passing through the position of FIG. 5. This causes the roller 54 to pull out of the rounded portion at the end of the slot and enter the parallel side wall portion of the slot 60 responding to the force going from pin 19 to pin 53. Roller 54 rolls up the parallel portion surface quickly allowing the drive arm 51 to rotate back to its rest position. The roller 54 at that point is rolled back to its second stable position located in the circular portion at the left-hand end of the slot as best shown in FIG. 6.

Generally when the rotary solenoid 14 is energized with the contact carrying switch shaft in either the 0° or 45° position, the electrical power is fed through normally closed contacts. These contacts are designed to feed power to the rotary solenoid during its 25° stroke and then open when the contact carrying switch shaft indexes to its desired position moving the final distance because of the urging of the compression spring drive of spring 101. This minimizes the time of energizing the rotary solenoid and thus reduces the watt/seconds of energy required to operate the switch of this invention. It also can deenergize the highly inductive solenoid coil to eliminate problems due to DC arcing.

Although the rotary solenoid shaft rotates only 25° when energized, and the drive arm 51 and pin 53 also rotate 25°, the selector hub rotates at a slightly faster rate than the drive arm 51 because the radii R2 and R3 are selected to cause this action. Thus R2 is greater than R3 as by 0.08 inch. Thus the moment arm of the drive arm 51 is greater than the moment arm of the driven object. This causes the selector hub to rotate 30° for each 25° rotation of the rotary solenoid to further insure that the 25° rotation of the solenoid stroke will always move the selector hub beyond mid-position or 22½° of rotation and positively drive the contacts 45° at each stroke of the rotary solenoid drive arm 51.

When the rotary solenoid is deenergized, roller 54 locates as described with respect to FIG. 3 and locks in, remaining there during the 25° power stroke of the rotary solenoid. This causes the selector hub 20 to be driven 30°. If a diameter were not present at the end of the slot 60 so that the roller would lock in it, rotation could not be imparted from the rotary solenoid to the selector hub because the drive link 18 is not perpendicular to the parallel side walls of the slot 60. There is an angle caused by the distance between pin 53 and the center of shaft 50 being larger than the distance between pin 19 and the center of shaft 16. This angle 28 (FIG. 3)

is between a line through the center of pins 53 and 19 and a line perpendicular to the side walls of the slot. This angle would normally cause the roller 54 when driven to roll along a center line of the parallel portion of the slot 60 toward the center of the selector hub.

FIG. 5 shows the selector hub at 30° of rotation where the rotary solenoid deenergizes and its return spring pulls the roller 54 toward its second stable position as the selector hub continues to rotate toward 45°. FIG. 6 shows the 45° position with the parts having shifted to that position. A reversal is carried out by a second operation of the drive arm of the rotary solenoid in the same direction as the first operation of the drive arm.

The switch parts are made of conventional metallic materials as known in the art. The segments are formed of known insulating plastic. The switch preferably is highly compact since a small solenoid can be used as for example one having a torque of 10 in/lbs. The cover 13 can have a height of 3½" and a width of 2¼". The cover can be used to attach to a panel in the art. The contacts within the rotary switch are preferably mechanical contacts and are urged into position by the spring 101 positively preventing opening by random shock or vibration normally encountered in use. The stop pin 97 and slot 98 can be arranged to have a width allowing a smaller degree of rotational travel of the bearing 95 than the degree of rotational travel permitted by stop pin 85. This prevents the handle being twisted off. The portion 91 is preferably of a resilient stamped metal to allow flexibility and prevent any tendency of the switch to bind due to hang up of the manual portion. The handle shaft 90 can be attached to the flat plate 91 by a rapid disconnect connection to enable replacement with different length shafts to accommodate various thickness panels thus adding to versatility of the switch.

While a specific embodiment of the present invention has been shown and described, many variations are possible. For example, a rigid linkage 91 can be used although it is not preferred. The number of contacts and segments used can vary as desired. The spring pressure exerted on the rollers can be exerted by other spring arrangements. Similarly the spring bias of spring 101 can be provided by other spring arrangements although the structure shown is preferred.

What is claimed is:

1. A latching switch relay capable of manual and remote electrical actuation of a switch shaft to cause switching of contacts, said latching switch relay comprising, said switch shaft carrying a plurality of electrical contacts and having a first switch position and a second switch position, means mounting said shaft for reciprocal rotation about an axis of said shaft, spring means for urging said contact carrying shaft into said first position and resiliently maintaining said shaft in said first position, said spring means further acting to alternately urge said shaft into said second position and resiliently maintain said shaft in said second position.

a rotary solenoid for causing movement of said shaft from said first to said second position and vice versa, said rotary solenoid carrying a drive link for translating unidirectional driving torque of said solenoid into mechanical power to alternately move said shaft clockwise to said second position and counterclockwise to said first position.

2. A latching switch relay in accordance with claim 1 and further comprising said spring means being mounted to engage a selector hub which is linked to said contact carrying shaft to cause rotation thereof along with corresponding rotation of said hub, and a manually operable handle shaft linked to said contact carrying shaft whereby said contact shaft can be moved from said first to said second position and vice versa by operation of said handle shaft.

3. A latching switch relay in accordance with claim 2 wherein said linkage between said handle and said contact shaft is through said selector hub.

4. A latching switch relay in accordance with claim 3 and further comprising said linkage further including a flexible metallic flat member having a C-shaped configuration with one end linked to move directly with movement of said selector hub.

5. A latching switch relay in accordance with claim 4 and further comprising a support wall having a bearing mounting said selector hub for rotation along with said switch shaft about an axis of said switch shaft, means limiting movement of said selector hub to first and second positions corresponding to said first and second shaft position, said spring means comprising a post extending from said selector hub engaging an elongated coil spring at one end of said spring with the other end of said spring biased against a stop, said coil spring having a central axis and being pivotal about said axis at said one end whereby arcuate movement of said post extending from said selector hub acts to compress said spring and move the end adjacent said post through an arc, said rotary solenoid being capable of carrying said spring through a first arcuate movement whereupon said spring reaction causes said post to move said selector hub over a second arcuate movement due to the action of said spring alone.

6. A latching switch relay in accordance with claim 5 and further comprising a selector plate defining an elongated drive slot and fixed to said selector hub parallel therewith, said solenoid having a solenoid shaft with a drive arm extending from said shaft mounting a drive link at a first pivot pin, a second end of said drive link carrying a roller mounted in said selector plate slot, spring means for urging said roller and drive arm in a direction so as to urge said roller against one end of said slot, said slot defining a first diameter at one end thereof and a second diameter corresponding to said first diameter at a second end thereof with the diameters being equal and greater than the width of said slot at a central portion thereof.

7. A latching switch relay in accordance with claim 6 wherein said handle has a shaft coaxially with said switch shaft and fixed to a second end of said C-shaped flexible flat member of said linkage, and stop means for limiting axial movement of said handle shaft to prevent damage to said latching switch relay.

8. A latching switch relay in accordance with claim 7 and further comprising said spring means acting to move said selector plate and switch shaft over a greater arcuate distance than the arcuate distance of movement of a shaft of said rotary solenoid whereby said spring means acts to maintain said switch shaft in said first or second position and also to drive said switch shaft fully to said first or second position with a strong force.

9. A latching switch relay in accordance with claim 5 wherein said coil spring is a compression spring and is pivotal at said one end about a stop mounted at said one end of said coil spring.

10. In an electrical switch relay having a plurality of circularly arranged first contacts and a central switch shaft carrying second contacts for alternately contacting selected ones of said first contacts, the improvement comprising, a selector hub fixed to said switch shaft and mounted for rotation about an axis of said switch shaft, stop means for determining a first position of said switch shaft and a second position of said switch shaft by stopping movement of said selector hub in said first and second position, spring means comprising a compression spring and a surrounding sleeve for resiliently locking said selector hub in said first or second position and acting to move said selector hub over a portion of its travel when moving to said first or second position so as to provide a driving force.

11. The improvement of claim 10 wherein said sleeve defines a slot and a post is fixed to said selector hub with an end extending into said slot acting on a first end of said compression spring.

12. The improvement of claim 11 and further comprising a pivot pin acting as a stop for said compression spring at a second end of said spring.

13. The improvement of claim 10 and further comprising a rotary solenoid interconnected with linkage means for moving said selector hub reciprocally from a first to a second position.

14. The improvement of claim 13 wherein said linkage means comprises a selector plate carrying a slot having enlarged diameter ends and a roller mounted in the slot and reactive to movement of a shaft mounted in said rotary solenoid to move said selector hub through a portion of arcuate travel to said first or second position.

15. The improvement of claim 14 further comprising spring means for switching said roller from one end of said slot to another end of said slot.

16. A method of moving a switch shaft of a rotary relay from a first to a second fixed arcuate position of operation and vice versa about an axis of said shaft, said method comprising interlinking a rotary solenoid and manual means for causing said moving by use of said rotary solenoid at one time and said manual means at another time to move said shaft from a first fixed position to a second fixed position and vice versa, said interlinking being carried out by said shaft being connected to said manual means by an intermediate resilient member.

* * * * *